US005375840A

United States Patent [19]

Hirsch et al.

[11] Patent Number: 5,375,840

[45] Date of Patent: Dec. 27, 1994

[54] GOLF CLUB IRON SET HAVING GRADED FACE ANGLES AND WEIGHT DISTRIBUTION

[75] Inventors: Robert D. Hirsch, Oceanside; Richard J. Liesz, Cardiff; Mark McClure, Carlsbad; Christopher Best, Encinitas, all of Calif.

[73] Assignee: Cobra Golf Incorporated II, Carlsbad, Calif.

[21] Appl. No.: 117,862

[22] Filed: Sep. 7, 1993

[51] Int. Cl.[5] ..... A63B 53/04

[52] U.S. Cl. ..... 273/77 A; 273/167 J; 273/167 G

[58] Field of Search ..... 273/77 A, 79, 167 A, 273/167 F–167 J, 171, 173

[56] References Cited

U.S. PATENT DOCUMENTS

| | | | |
|---|---|---|---|
| 959,053 | 5/1910 | Fowler | 273/80 C |
| 2,219,670 | 10/1940 | Wettlaufer | 273/79 |
| 4,854,582 | 8/1989 | Yamada | 273/79 |
| 4,883,274 | 11/1989 | Hsien | 273/173 |
| 4,913,435 | 4/1990 | Kobayashi | 273/77 A |
| 5,197,733 | 3/1993 | Schroder | 273/79 |
| 5,295,686 | 3/1994 | Lundberg | 273/77 A |

*Primary Examiner*—V. Millin
*Assistant Examiner*—Steven B. Wong
*Attorney, Agent, or Firm*—Brown, Martin, Haller & McClain

[57] ABSTRACT

A set of golf iron clubs is disclosed that, through unique structural features, provides excellent playing characteristics and enhances a player's ability to play accurate shots. Each club in the set has a head with a face angle of at least ½° and a concentration of mass formed within the head. Face angles decrease sequentially from the longest iron in the set to the shortest iron in the set, while the Concentrations of mass also vary sequentially in location from a high heel location in the longest iron to being disposed further toward a sole and toe location in the shortest iron. The face angles are preferably at least 1°, more preferably in the range of ½° to 5°, and most preferably in the range of about 1° to about 3½°. Also disclosed are the individual clubs in the set. The shaft grip of each club also incorporates a reminder for enabling a golfer to maintain the striking face in proper alignment with the golf ball.

16 Claims, 2 Drawing Sheets

GOLF CLUB IRON SET HAVING GRADED FACE ANGLES AND WEIGHT DISTRIBUTION

BACKGROUND OF THE INVENTION

1. Field of the Invention

The invention herein relates to golf club sets. More particularly it relates to sets of irons.

2. Description of the Prior Art

Golfers are always seeking golf club sets which can help them to improve their games, Since each golfer is an individual with his or her own playing style and ability, it is desirable to have golf club sets designed to assist the widest range of players in playing good golf shots. To this end there have been numerous prior art designs of clubs which are said to improve a player's game, or to assist in correction of bad aspects of the mechanics of a player's shots. Some of these designs have had success; most have not.

Because the iron clubs are used the most during a round of golf, and used in a wider variety of playing situations than are woods, an improvement in the design of irons would be very advantageous to golfers. Consequently it would be desirable to have an iron set which could serve to assist both average and skilled players in producing consistently good golf shots throughout a round of golf. It is to that object that the design of the present invention is directed.

SUMMARY OF THE INVENTION

The invention herein is a set of golf iron clubs that, through unique structural features, provides excellent playing characteristics and enhances a player's ability to play accurate shots.

In its broadest form, the invention is a golf club iron set comprising a plurality of iron clubs, each club of the plurality having a head with a face angle of at least ½° and a concentration of mass formed within the head. Face angles decrease sequentially from the longest iron in the set to the shortest iron in the set, while the concentrations of mass also vary sequentially in location from a high heel location in the longest iron to being disposed further toward a sole and toe location in the shortest iron. Also included are individual clubs in the set.

In a further embodiment, the invention is a golf club iron set comprising a plurality of iron clubs, each club of the plurality having a shaft joined to a head, the head having a heel, a toe, a sole, a top edge, and a striking face forming one surface thereof, the striking faces of the plurality of clubs increasing sequentially in loft, with the set further comprising that in each club there are mutually intersecting shaft plane, face plane and ground plane, which form a face angle which is the angle between the lines of intersection of the ground plane respectively with the shaft plane and the face plane, with the face angle having a measurement of at least ½°; the face angles of the plurality of clubs decreasing sequentially from the longest iron in the set to the shortest iron in the set; and in each club, the head having a section disposed substantially behind the striking face surface and divided into a plurality of portions of different depths from the striking face surface, with proportionally greater concentration of mass in the portions of greater depth; and in the set, the concentration of mass being disposed primarily substantially adjacent to the intersection of the top edge and the heel in the longest iron and being disposed further toward the sole and the toe sequentially in each club progressing to the shortest iron. Also included are individual clubs in the set.

The face angles are preferably at least 1°, more preferably in the range of ½° to 5°, and most preferably in the range of about 1° to about 3½°. The intersection point where the face angle is measured generally lies at a location below the optimum area on the club face for striking a golf ball, and preferably below the center of that area.

In preferred embodiments, the shaft of each club terminates in an elongated grip with the grip comprising reminder means for enabling a user of the club to maintain the striking face in proper alignment with a golf ball to be struck. The reminder preferably is an extended ridge-like projection aligned parallel to the shaft centerline and disposed for tactile engagement by at least one of the user's hands.

DETAILED DESCRIPTION AND PREFERRED EMBODIMENTS

Figure 8:
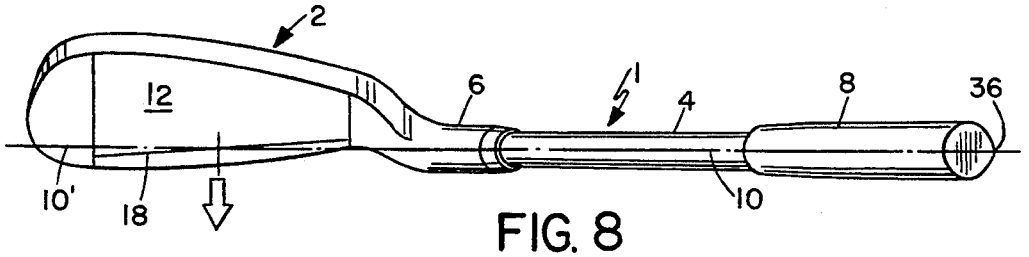
FIG. 8 is a view of an entire club from above, as generally viewed by the golfer, showing the relationship of the head and the shaft, and also illustrating an alignment reference: ridge incorporated in the hand grip.
Figure 9:
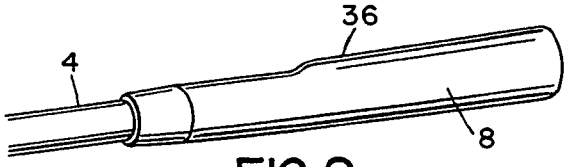
FIG. 9 is a side view of the club grip showing the alignment ridge in greater detail.

The present invention is: best understood by reference to the accompanying drawings. A typical golf club 1 of this invention is shown in FIG. 8 and has a head 2 and a shaft 4 which are joined at hosel 6. Shaft terminates at its upper end (the end distal from the head 2) in a grip 8. The shaft 4 also has an axial center line 10.

Figure 1:
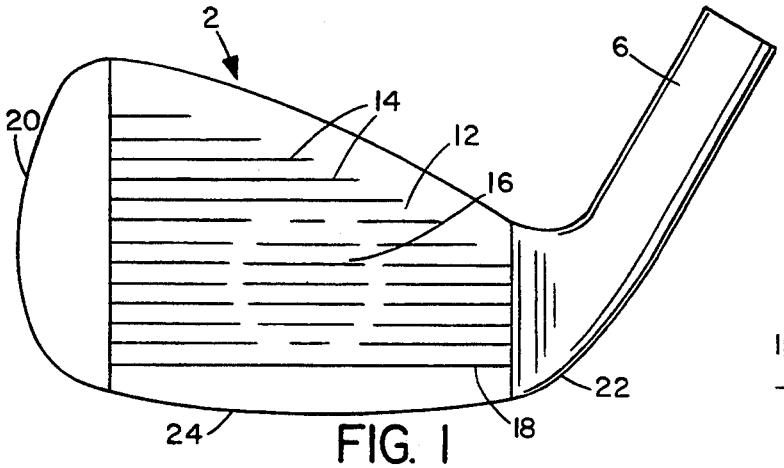
FIG. 1 is a front face view of a basic configuration of the club head.
Figure 2:
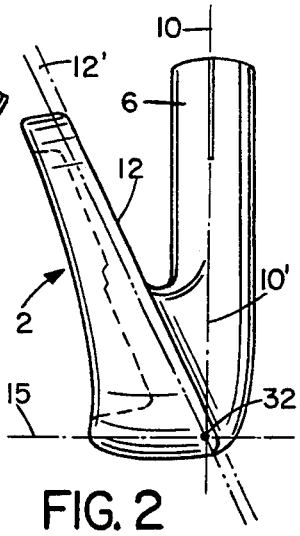
FIG. 2 is a toe end view of the head.
Figure 3:
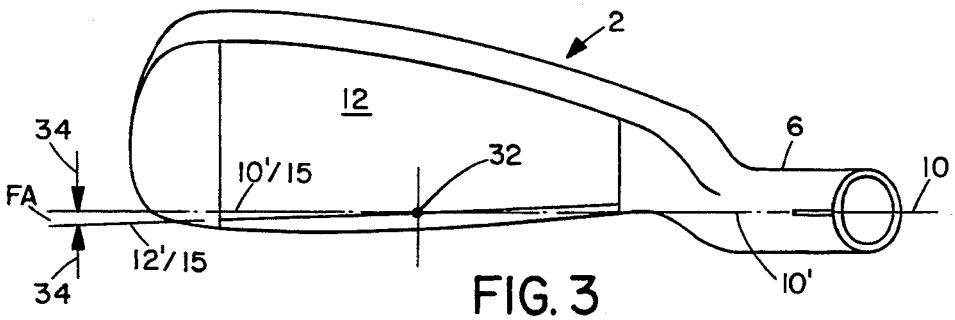
FIG. 3 is a top plan view of the head showing the face alignment angle relative to the shaft axis for a given club.
Figure 4:
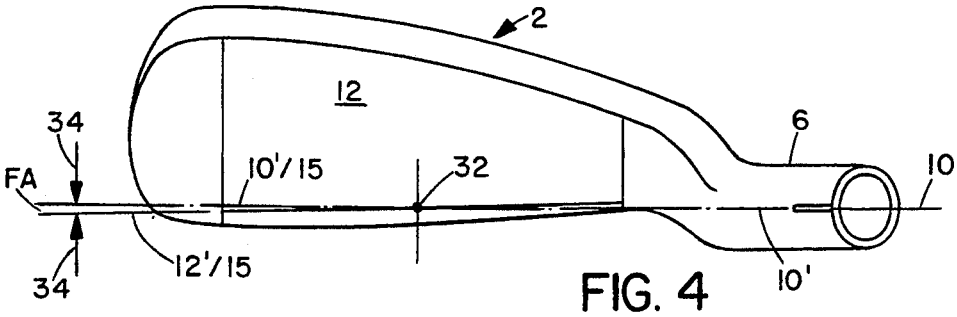
FIGS. 4 and 5 are views similar to FIG. 3 but illustrating other angular alignments for other representative clubs in the set.
Figure 5:
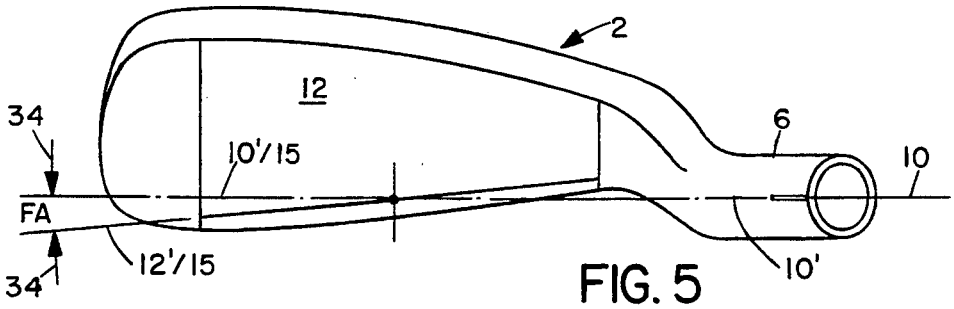
Figure 7:
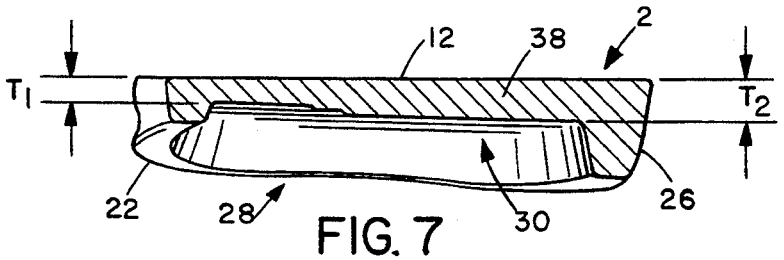
FIG. 7 is a sectional view taken on Line 7–7 of FIG. 6.

Head 2 has a striking face 12 formed on the front side of the club head. As best seen in FIGS. 2 and 7, face 12 is flat. It is usually scored by a number of parallel grooves 14 and often contains a "sweet spot" indicator 16 denoting the optimum location for striking a golf ball (not shown). Line 18 marks the lower edge of face 12. The remainder of the head 2 includes as components toe 20, heel 22, sole 24, back ridge 26, back 28 and cavity 30 molded into back 28. It will be understood that components such as toe 20, heel 22 and sole 24 represent areas of the club head 2 and not specific points.

Conventionally irons are numbered as integers from 1 to 9 in an increasing order of club loft and decreasing order of relative golf shot distance. Those with the lowest loft and longest distance are generally called the "long" irons (usually being the 1, 2 and 3 irons) while those with the greatest loft and shortest distance are termed the "short" irons (usually being 7, 8 and 9 irons). The "mid" irons are naturally those lying between the long irons and the short irons. These groupings are not exact but are conventional to designate the relative structures of the irons. Club sets may in addition include clubs such as wedges (those having greater loft and shorter distance than a 9 iron) as well as various "intermediate irons" which can be designed to have loft and distance properties intermediate to the standard numbered irons. For instance, a club called a "driving iron" may be considered to be in effect a "1½" iron.

The superior playing ability of the clubs of the present invention is based on two unique features of the club head structures. First, each iron has a face angle, with the face angles of the clubs decreasing through the club set from the longer to the shorter clubs. For the purposes of this invention, "face angle" is defined primarily by reference to FIGS. 2–5 and 8. The face angle is determined by three planes, best illustrated in FIG. 2. The first plane 10' (the "shaft plane") is the forward projections of center line 10 of shaft 4 toward the club head 2 (i.e, extending perpendicularly to the page in FIG. 2). The second plane 12' (the "face plane") is the extended plane of the club face 12. The third plane 15 (which also extends perpendicularly to the page in FIG. 2) is the "ground plane" and lies parallel to the ground when the club is grounded in the normal position of addressing a golf ball. Plane 10' intersects plane 15 along the line designated 10'/15, while plane 12' intersects plane 15 along line 12'/15. Planes 10' and 12' also intersect each other. However, there is only one point of three-way mutual intersection of the planes, which is indicated as point 32, and which is where lines 10'/15 and 12'/15 intersect.

Therefore, the face angle (designated FA) is the angle formed by the intersections of planes 10' and 12' with plane 15. This is graphically represented in FIGS. 3–5 as the angle formed by lines 10'/15 and 12'/15 at their intersection at point 32.

Point 32 will normally be near, and is preferably at, a location directly below the center of the indicator 16. It may lie above, below or on line 18, depending on the offset of the club head 2 with respect to the shaft 4.

It will be recognized that the face angle is reflected in the orientation of the club head 2 with respect to the shaft 4, and that it is also represents a visual orientation as perceived by the golfer using the club 1. In other words, as best seen in FIGS. 3–5 and 8, it can be considered to be the visual angle (projected onto the plane 15) that the golfer sees as he or she stands holding the club 1 in the normal position of addressing the ball and looks down the club shaft 4.

In all prior art clubs, the club faces have been "parallel" to the shaft centerline. In other words, (using FIGS. 2 and 3 for reference) prior art planes 10' and 12' have intersected plane 15 in parallel lines, not in intersecting lines. There is no equivalent to point 32, and the "face angle" is 0°. To obtain the superior playing properties of the present club set, however, the face angle FA must be at least ½°, will preferably range from ½° to 5° and most preferably will be between 1° and 3½°.

The face angles vary inversely with the club number, with the smallest face angle being formed in the shortest club. This is illustrated schematically by FIG. 4, which can be seen as representing a typical short iron, and a face angle of ½° to about 1½°–2°. In the mid-irons, indicated generally by FIG. 3, the face angle is typically in the range of about 1½°–2° up to 2½°–2¾°, while in the long irons, best illustrated by FIG. 5, the angle is closer to the maximum of 3° to 3½° or greater. The angle decreases sequentially through the club set, so that each club face will have a slightly greater face angle than a club next shorter to it and slightly less than the club next longer to it. Preferably, the differential angle between any two clubs in the conventional integer numbered series will be the same so that there is an even progression of decreasing face angle from longer to shorter clubs.

As discussed above, the clubs of this present invention present a distinctive visual appearance to the golfer as he or she holds the club to address the ball, since the club face 12 clearly appears aligned at a visible angle to the plane 10' of shaft 4. This can appear to the golfer unfamiliar with this set to make the club seem to be misaligned with respect what he or she expects to see when addressing the ball. The golfer then has a tendency to try to rotate or turn the club shaft 4 to cause the club face 12 to appear to be a 0° face angle, to present an appearance equivalent to the appearance of prior art clubs with which the golfer has previously been familiar. For the present club set, however, this causes the club head 2 to be turned incorrectly with respect to addressing the ball. If the golfer then swings the club 1 with the club head 2 turned "backwards" (i.e., with the face angle FA appearing to be visually 0°) the club face 12 will strike the ball at an incorrect angle, resulting in a poor golf shot.

Consequently, a "reminder" device is incorporated into the grip 8 in the form of extended ridge 36. Ridge 36 lies along the underside of grip 8 and its longitudinal axis lies in plane 10'. When a golfer grips the grip 8 to address the ball, the ridge 36 lies comfortably in the underside of the joints of the golfer's fingers, thus indicating to the golfer that the club 1 is being properly held and aligned to correctly address the ball with respect to the appropriate face angle for the particular club selected. The correct visual appearance to the golfer is as appears in FIG. 8. However, if the golfer seeks to revert to making a "visual correction," to make the club face appear to have a 0° face angle in the manner of prior art clubs, turning the club shaft 4 to accomplish that visual correction will force the ridge 36 to turn out of plane 10' and therefore will no longer lie comfortably along the joints of the golfer's fingers. This will cause the golfer to realize that, since his or her grip on the club 1 no longer feels "correct," the club 1 is now not properly aligned for correctly addressing the ball. The golfer will then realize that the club 1 must be aligned to have the proper face angle FA when addressing the ball, which will be indicated to the golfer by the resulting "comfortable" feel of the reminder ridge 36 in the golfer's hands.

In addition to the formation of sequential face angles FA through the club set of this invention, the second major factor in the improved play is the presence of an internal weight (mass) concentration in each of the club heads 2, with the weight distribution shifting sequentially throughout the club set, as best illustrated in FIGS. 7 and 10A–C. In the present set, the weight concentration in each club head 2 is internal to the club head structure, rather than being in the form of a lump or protrusion mounted on the side of the club head.

Considering first FIG. 7, it will be seen that the club head 2 has a depth of thickness behind face 12 which is designated as body 38. In iron sets of the prior art, the body 38 has been of generally uniform thickness across the club head 2, whether measured vertically or horizontally. Occasionally the thickness of the prior art body will increase at or near the sole for bottom weighting. In the present invention, however, the thickness varies both horizontally and vertically, as indicated in FIG. 7. FIG. 7 illustrates as an example the configuration of a typical short iron (also seen in FIG. 10C), in which the weight concentration is near the toe 26. The concentration is in the form of a greater thickness of the low toe portion of body 38, indicated by the dimension $T_2$, while toward the heel of the club at a higher elevation the body 38 is thinner as indicated by dimension $T_1$.

Figure 10C:
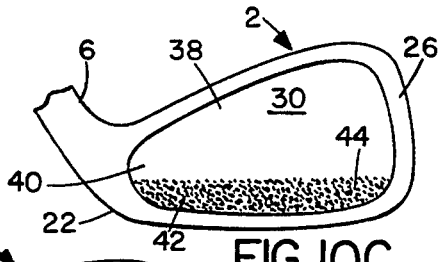
FIGS. 10A, 10B and 10C are diagrammatic views in which the club head mass distribution and location are shown schematically for three representative clubs in the set.
Figure 10A:
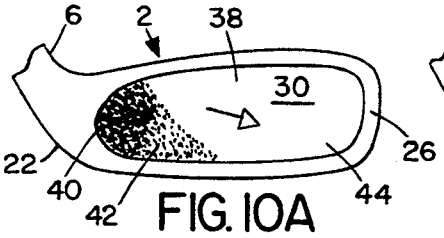
Figure 10B:
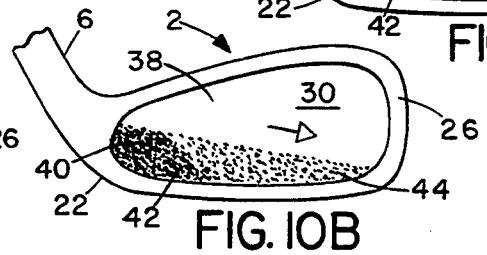

The weight distribution shift is indicated graphically in FIGS. 10A, 10B and 10C. FIG. 10A represents the long irons, while FIGS. 10B and C represent mid-irons and short irons respectively. The three significant areas of the club body 38 for the purposes of considering weight distribution are designated respectively 40, 42 and 44 and can be defined as the "high heel" 40, the "low heel" 42 and the "low toe" 44. It will be seen that the greatest concentration of mass which is formed by a greater thickness of the body 38 and is indicated by the denser stippling, is in the longer irons at the high heel position 40 with a lesser but still increased distribution spreading into the low heel area 42, while the toe area 44 is of the normal body thickness and does not have any mass concentration. In sequential progress through the club set from the longer to the shorter irons, the mass concentration shifts downward toward the sole and forward toward the toe, and also becomes more distributed and uniform, as indicated first in FIG. 10B by the denser stippling and the lighter stippling extending toward the low toe position 44, while with the shortest clubs as indicated in FIG. 10C the concentration is now generally evenly distributed across the lower part of body 38 with little or no concentration in the high heel position, such that the thickness of body 38 is now greatest along the sole 24 of the club and least to toward the upper part of the body 38.

Figure 6:
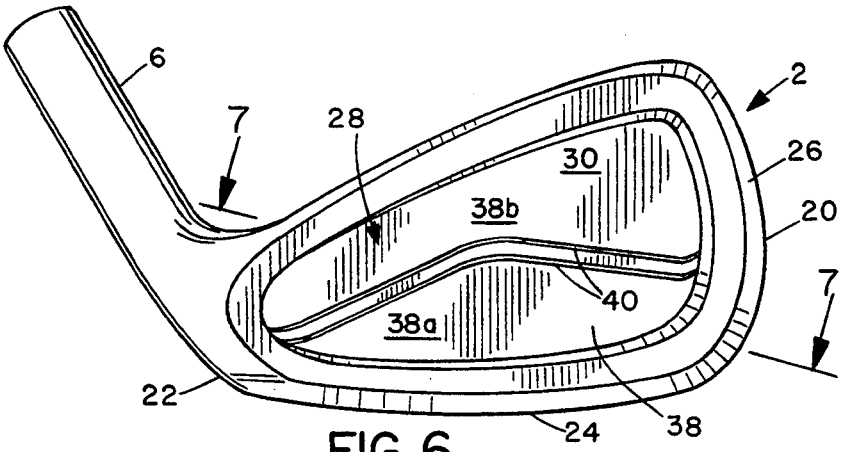
FIG. 6 is a rear or back view of the head.

The exact location of the concentration of mass will vary throughout the club set and can be adjusted slightly depending on the particular club design. In the clubs illustrated (as best shown in FIG. 6), the body 38 has a lower portion of slightly greater thickness designated **38*a* as compared to the upper portion 38*b* with a step configuration shown as 40. This provides an unique ornamental appearance to the club head (for which we have also simultaneously applied for a design patent). The location and shift of weight concentration as shown in FIGS. 10A–10C will then be varied slightly to account for the ornamental change in the body as compared to the exact location and shift that would be found in a club with a flush back 28. However, regardless of the specific ornamental design which may be incorporated into the club head 2**, the overall location of mass concentration and degree of shift will be sequential throughout club set, starting with the concentration at the high heel position and then spreading out more along sole toward the low toe position as shown in the FIGURES.

It will be evident from the above that there are numerous embodiments of this invention which, while not expressly described above, are clearly within the scope and spirit of the invention. The above description is therefore intended to be exemplary only, and the full scope of the invention is to be defined solely by the appended claims.

We claim:

1. A golf club iron set comprising a plurality of iron clubs, each club of said plurality having a head with a face angle of at least $\frac{1}{4}°$ and a concentration of mass formed within said head, and wherein face angles decrease sequentially from the longest iron in said set to the shortest iron in said set.

2. A golf club iron set as in claim 1 wherein said concentrations of mass vary sequentially in location from a high heel location in the longest iron thereof to being disposed further toward a sole and toe location in the shortest iron thereof.

3. A golf club iron set as in claim 2 wherein further said face angles decrease sequentially from the longest iron in said set to the shortest iron in said set.

4. A club set as in claim 1 wherein said shaft of each club terminates in an elongated grip at the end distal from said head and said grip comprising means for enabling a user of said club to maintain said striking face in proper alignment with a golf ball to be struck.

5. A club set as in claim 4 wherein said means comprises an extended projection aligned parallel to said shaft centerline and disposed for tactile engagement by at least one of said user's hands.

6. A club set as in claim 1 wherein said face angle is at least 1°.

7. A club set as in claim 1 wherein said face angle is in the range of $\frac{1}{2}°$ to 5°.

8. A club set as in claim..8 wherein said face angle is in the range of about 1° to about $3\frac{1}{2}°$.

9. A golf club iron set comprising a plurality of iron clubs, each club of said plurality having a shaft joined to a head, said head having a heel, a toe, a sole, a top edge, and a striking face forming one surface thereof, the striking faces of said plurality of clubs increasing sequentially in loft, said set further comprising:

in each club there are mutually intersecting shaft plane, face plane and ground plane, said planes forming a face angle being the angle between the 8 lines of intersection of said ground plane respectively with said shaft plane and said face plane, with said face angle having a measurement of at least $\frac{1}{2}°$, and wherein face angles decrease sequentially from the longest iron in said set to the shortest iron in said set;

in each club, the head thereof having a section disposed substantially behind said striking face surface, said section being divided into a plurality of portions of different depths from said striking face surface, with proportionally greater concentration of mass in said portions of greater depth; and in said set, said concentration of mass being disposed primarily substantially adjacent to the intersection of said top edge and said heel in the longest iron thereof and said concentration of mass being disposed further toward said sole and said toe sequentially in each club progressing to the shortest iron thereof.

10. A club set as in claim 9 wherein said shaft of each club terminates in an elongated grip at the end distal from said head and said grip comprising means for enabling a user of said club to maintain said striking face in proper alignment with a golf ball to be struck.

11. A club set as in claim 10 wherein said means comprises an extended projection aligned parallel to said shaft centerline and disposed for tactile engagement by at least one of said user's hands, 12. A club set as in claim 9 wherein said face angle is at least 1°

13. A club set as in claim 9 wherein said face angle is in the range of ½° to 5°.

14. A club set as in claim 13 wherein said face angle is in the range of about 1° to about 3½°.

15. A club set as in claim 10 wherein a point of mutual intersection of said planes lies at a location below the optimum area on said club face for striking a golf ball.

16. A club set as in claim 17 wherein said point lies generally below the center of said optimum area.

* * * * *

UNITED STATES PATENT AND TRADEMARK OFFICE

CERTIFICATE OF CORRECTION

PATENT NO. : 5,375,840

DATED : December 27, 1994

INVENTOR(S) : Robert D. Hirsch et al.

It is certified that error appears in the above-indentified patent and that said Letters Patent is hereby corrected as shown below:

IN THE ABSTRACT:

- Line 8, change "Concentrations" to --concentrations--.

IN THE SPECIFICATION:

- Column 2, line 37, delete ":" after "reference";
- Column 2, line 48, delete ":" after "is";
- Column 2, line 51, after "shaft" (second occurrence) insert --4--.

IN THE CLAIMS:

- Column 6, claim 1, line 4, delete "¼" and insert --½--;
- Column 6, claim 8, line 29, delete "8" and insert --7--;
- Column 6, claim 9, line 39, delete "8";
- Column 6, claim 9, line 57, delete blank space after "further" to continue the sentence with "toward...";
- Column 8, claim 16, line 3, delete "17" and insert --15--.

Signed and Sealed this

Eighteenth Day of April, 1995

Bruce Lehman

*Attest:*

BRUCE LEHMAN

*Commissioner of Patents and Trademarks*

*Attesting Officer*